US007198263B2

(12) United States Patent
Acton

(10) Patent No.: US 7,198,263 B2
(45) Date of Patent: Apr. 3, 2007

(54) DUAL TRAY SELECTABLE SHEET PICKING ASSEMBLY

(75) Inventor: Larry W. Acton, London, KY (US)

(73) Assignee: Lexmark International, Inc., Lexington, KY (US)

( * ) Notice: Subject to any disclaimer, the term of this patent is extended or adjusted under 35 U.S.C. 154(b) by 471 days.

(21) Appl. No.: 10/828,902

(22) Filed: Apr. 21, 2004

(65) Prior Publication Data

US 2005/0236759 A1 Oct. 27, 2005

(51) Int. Cl.
*B65H 3/44* (2006.01)

(52) U.S. Cl. ..... 271/9.05; 271/9.06; 271/9.11; 271/9.12; 347/104

(58) Field of Classification Search ..... 271/9.05, 271/9.06, 9.11, 9.12; 347/104; 399/391; 400/584, 605

See application file for complete search history.

(56) References Cited

U.S. PATENT DOCUMENTS 4,417,282 A 11/1983 Yamamoto
4,722,518 A 2/1988 Watanabe
4,770,555 A 9/1988 Deschamps et al.
5,078,380 A 1/1992 Kitazawa
5,582,398 A 12/1996 Long
5,678,814 A 10/1997 Yokoyama et al.
6,152,561 A * 11/2000 Watanabe ..... 347/104
6,298,778 B1 10/2001 Onodera et al.
6,929,414 B2 * 8/2005 Kadomatsu ..... 400/608.2
2001/0010414 A1 * 8/2001 Yukimachi ..... 271/9.11
2002/0130458 A1 * 9/2002 Okada et al. ..... 271/9.12
2003/0020229 A1 * 1/2003 Nishimura ..... 271/9.05

FOREIGN PATENT DOCUMENTS

JP 02089732 A 3/1990

* cited by examiner

*Primary Examiner*—David H. Bollinger
(74) *Attorney, Agent, or Firm*—Taylor & Aust

(57) ABSTRACT

An imaging apparatus includes a printhead carrier system including a printhead carrier configured for movement along a scan path, a first sheet picking mechanism, a second sheet picking mechanism, and a selector device. The selector device is configured to select one of the first sheet picking mechanism and the second sheet picking mechanism for picking a sheet of print media based on a position of the printhead carrier.

17 Claims, 3 Drawing Sheets

DUAL TRAY SELECTABLE SHEET PICKING ASSEMBLY

BACKGROUND OF THE INVENTION

1. Field of the Invention

The present invention relates to an imaging apparatus, and, more particularly, to a dual tray selectable sheet picking assembly.

2. Description of the Related Art

An imaging apparatus, such as an ink jet printer, may include multiple print media sources, such as for example, two paper trays. In one configuration of an imaging apparatus having two media sources, a single sheet picking mechanism is rotatable between two positions. In a first position, the picking mechanism has its pick rolls rotate in one direction to pick the top sheet of a first source of media. In a second position, the picking mechanism has its pick rolls rotate in the opposite direction to pick the bottom sheet of a second source of media. Such an approach, however, necessitates that the sheet picking mechanism be positioned between the two print media sources.

In another configuration, the imaging apparatus having multiple print media sources includes an independent sheet picking unit for each of the multiple print media sources. For example, if the imaging apparatus has two print media sources, the apparatus includes two sheet picking units and, in turn, two drive motors and two drive shafts. Such an approach, however, increases the complexity and cost of the imaging apparatus each time an additional sheet picking unit is added.

What is needed is the art is a sheet picking mechanism that accommodates sheet picking from multiple media sources using independent pick rollers, without needing multiple sheet picking motors and multiple pick drive shafts.

SUMMARY OF THE INVENTION

The present invention provides a sheet picking mechanism that accommodates sheet picking from multiple media sources using independent pick rollers, without needing multiple sheet picking motors and multiple pick drive shafts.

The present invention, in one form thereof, relates to an imaging apparatus. The imaging apparatus includes a printhead carrier system including a printhead carrier configured for movement along a scan path, a first sheet picking mechanism, a second sheet picking mechanism, and a selector device. The selector device is configured to select one of the first sheet picking mechanism and the second sheet picking mechanism for picking a sheet of print media based on a position of the printhead carrier.

In another form thereof, the present invention relates to a sheet picking device for an imaging apparatus. The sheet picking device includes a first sheet picking mechanism and a second sheet picking mechanism. A drive shaft is provided having a first section, a second section, and a third section located between the first section and the second section. The third section includes a spline. The first sheet picking mechanism includes a first drive gear rotatably coupled to the first section of the drive shaft. The first drive gear includes a first driven member. The second sheet picking mechanism includes a second drive gear rotatably coupled to the second section of the drive shaft. The second drive gear includes a second driven member. An engagement sleeve includes a bore for receiving the drive shaft. The bore has a spline channel that is configured to slidably receive the spline of the third section of the drive shaft. The engagement sleeve has a first end, a second end and an intermediate portion located between the first end and the second end. The first end has a first drive member for selectably engaging the first driven member of the first drive gear. The second end has a second drive member for selectably engaging the second driven member of the second drive gear. A selector linkage is coupled to the engagement sleeve. The selector linkage is configured to slide the engagement sleeve along an axis of the drive shaft to selectively position the engagement sleeve in engagement with one of the first driven member of the first drive gear and the second driven member of the second drive gear.

An advantage of the present invention is that sheet picking from multiple media sources is accommodated using independent pick rollers, without needing multiple sheet picking motors and multiple pick drive shafts.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
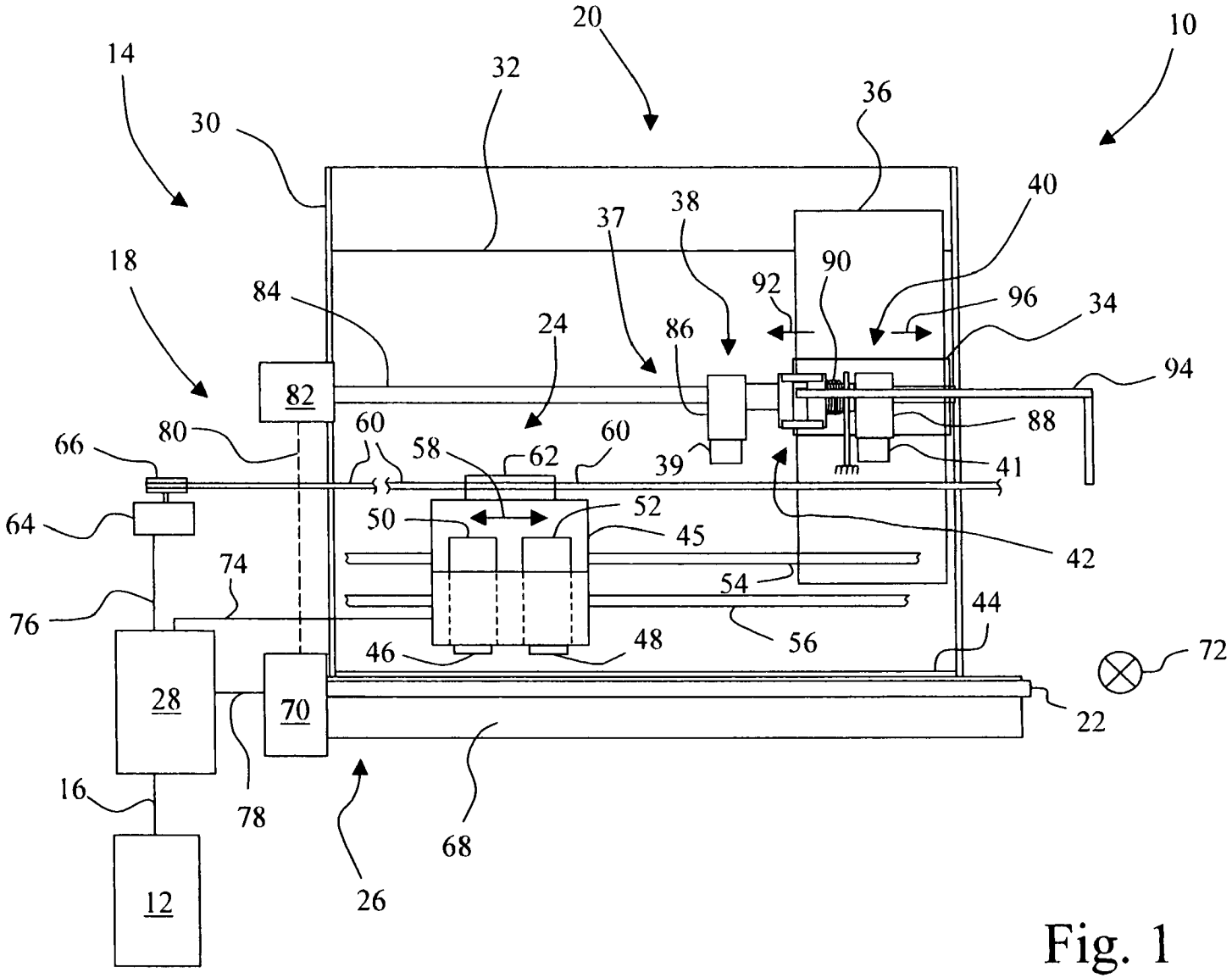
FIG. 1 is a diagrammatic front view of an imaging system embodying the present invention.

Referring now to the drawings, and particularly to FIG. 1, there is shown an imaging system 10 embodying the present invention. Imaging system 10 may include a host 12, or alternatively, imaging system 10 may be a standalone system.

Imaging system 10 includes an imaging apparatus 14, which may be in the form of an ink jet printer 14 as shown. Thus, for example, ink jet printer 14 may be a conventional ink jet printer, or may form the print engine for a multifunction apparatus, such as for example, a standalone unit that has faxing and copying capability, in addition to printing.

Host 12, which may be optional, may be communicatively coupled to imaging apparatus 14 via a communications link 16. Communications link 16 may be, for example, a direct electrical connection, a wireless connection, or a network connection.

In embodiments including host 12, host 12 may be, for example, a personal computer including a display device, an input device (e.g., keyboard), a processor, input/output (I/O) interfaces, memory, such as RAM, ROM, NVRAM, and a mass data storage device, such as a hard drive, CD-ROM and/or DVD units. During operation, host 12 includes in its memory a software program including program instructions that function as a printer driver for imaging apparatus 14. The printer driver is in communication with imaging apparatus 14 via communications link 16. The printer driver, for example, includes a halftoning unit and a data formatter that places print data and print commands in a format that can be recognized by imaging apparatus 14. In a network environment, communications between host 12 and imaging apparatus 14 may be facilitated via a standard communication protocol, such as the Network Printer Alliance Protocol (NPAP).

Imaging apparatus 14 includes a printing mechanism 18, a print media source 20, and a mid-frame 22. Printing mechanism 18, when in the form of an ink jet printer, includes a printhead carrier system 24 and a feed roller unit 26, as well as a controller 28. Print media source 20 includes a primary media tray 30 for holding a primary print media 32, and a secondary (or auxiliary) media tray 34 for holding a secondary print media 36.

A sheet picking assembly 37 provides selectable sheet picking from one of primary media tray 30 and secondary media tray 34. Sheet picking assembly 37 includes a primary sheet picking mechanism 38, a secondary sheet picking mechanism 40, and a sheet picking mechanism selector device 42.

Primary sheet picking mechanism 38 includes a sheet picking roller 39, and is positioned to pick a sheet of primary print media 32 from primary media tray 30. Secondary sheet picking mechanism 40 includes a sheet picking roller 41, and is positioned to pick a sheet of secondary print media 36 from secondary media tray 34. Sheet picking mechanism selector device 42 provides for the selectable actuation of one of primary sheet picking mechanism 38 and secondary sheet picking mechanism 40.

A picked media sheet 44 (i.e, a media sheet from one of primary print media 32 and secondary print media 36) is transported to feed roller unit 26, which in turn further transports media sheet 44 during a printing operation over mid-frame 22, which provides support for media sheet 44 during the printing operation. The picked media sheet 44 may be, for example, plain paper, coated paper, photo paper, transparency media or envelopes, of various sizes, depending on from which of media trays 30, 34 that media sheet 44 was picked. For example, primary media tray 30 may contain A4 sized plain paper as primary print media 32, and secondary media tray 34 may contain envelopes as secondary print media 36.

Printhead carrier system 24 includes a printhead carrier 45 for mounting and carrying a printhead 46, e.g., a color printhead, and/or a printhead 48, e.g., a monochrome or photo color printhead. An ink reservoir 50, which may include color inks, is provided in fluid communication with printhead 46. An ink reservoir 52, which may include a monochrome ink or photo color inks, is provided in fluid communication with printhead 48. Those skilled in the art will recognize that printhead 46 and ink reservoir 50 may be formed as individual discrete units, or may be combined as an integral unitary printhead cartridge. Likewise, printhead 48 and ink reservoir 52 may be formed as individual discrete units, or may be combined as an integral unitary printhead cartridge.

Printhead carrier 45 is guided by a pair of guide members 54, 56, such as for example, guide rods, which generally define a bi-directional scanning path 58 for printhead carrier 45. Printhead carrier 45 is connected to a carrier transport belt 60 via a carrier drive attachment device 62. Carrier transport belt 60 is driven by a carrier motor 64 via a carrier pulley 66.

At the directive of controller 28, printhead carrier 45 is transported in a reciprocating manner along guide members 54, 56. Carrier motor 64 can be, for example, a direct current (DC) motor or a stepper motor.

Feed roller unit 26 includes, for example, a feed roller 68, pinch rollers (not shown) and a drive unit 70. Feed roller 68 is driven by drive unit 70. The pinch rollers apply a biasing force to hold the media sheet 44 in contact with respective driven feed roller 68. Drive unit 70 includes a drive source, such as for example a direct current (DC) motor, and an associated drive mechanism, such as a gear train or belt/pulley arrangement. Feed roller unit 26 feeds the media sheet 44, received from print media source 20, in a sheet feed direction 72 designated as an X in a circle in FIG. 1 to indicate that the sheet feed direction is out of the plane of FIG. 1 toward the reader. The sheet feed direction 72 is commonly referred to as the vertical direction, which is perpendicular to the horizontal bi-directional scanning path 58. Thus, with respect to media sheet 44, carrier reciprocation occurs in a horizontal direction and media advance occurs in a vertical direction, and the carrier reciprocation is generally perpendicular to the media advance.

Controller 28 is electrically connected and communicatively coupled to printheads 46, 48 via a communications link 74, such as for example a printhead interface cable. Controller 28 is electrically connected and communicatively coupled to carrier motor 64 via a communications link 76, such as for example an interface cable. Controller 28 is electrically connected and communicatively coupled to drive unit 70 via a communications link 78, such as for example an interface cable.

Controller 28 may be formed as an application specific integrated circuit (ASIC), and includes processing capability, which may be in the form of a microprocessor having an associated random access memory (RAM) and read only memory (ROM). Controller 28 executes program instructions to effect the printing of an image on media sheet 44, such as for example, by selecting the index feed distance of print media sheet 44 as conveyed by feed roller 68, controlling the reciprocation of printhead carrier 45, and controlling the operations of printheads 46, 48. In addition, controller 28 executes instructions to effect the timely picking of print media from print media source 20, using one of primary sheet picking mechanism 38 and secondary sheet picking mechanism 40.

Each of primary sheet picking mechanism 38 and secondary sheet picking mechanism 40 receives its motive force from drive unit 70. For example, drive unit 70 may be coupled via a transmission device 80 (represented by a dashed line), such as by a belt or gear train, to a sheet pick drive unit 82. In turn, sheet pick drive unit 82 is coupled to a sheet pick drive shaft 84. Sheet pick drive shaft 84 supports a pivoting arm 86 of primary sheet picking mechanism 38 and supports a pivoting arm 88 of secondary sheet picking mechanism 40. Sheet picking mechanism selector device 42 then selectively transmits the motive force to one of primary sheet picking mechanism 38 and secondary sheet picking mechanism 40.

Alternatively, sheet pick drive unit 82 may include a motor, separate from feed roller drive unit 70, which is used as a power source for selectively driving one of primary sheet picking mechanism 38 and secondary sheet picking mechanism 40 via sheet picking mechanism selector device 42.

Thus, in accordance with the present invention, one of primary sheet picking mechanism 38 and secondary sheet picking mechanism 40 is selected for media picking by sheet picking mechanism selector device 42. In the example shown in FIG. 1, a spring assembly 90, such as a coil spring and associated mounting structure, is positioned to apply a biasing force in direction 92 to sheet picking mechanism selector device 42 to provide a default engagement of sheet pick drive shaft 84 with primary sheet picking mechanism 38. However, with the orientation of components as shown in FIG. 1, by shifting printhead carrier 45 to the far-right, printhead carrier 45 will engage a portion of a selector linkage 94, thereby overcoming the biasing effect of spring assembly 90, and shifting sheet picking mechanism selector device 42 in direction 96 to disengage sheet pick drive shaft 84 from primary sheet picking mechanism 38, and to engage sheet pick drive shaft 84 with secondary sheet picking mechanism 40.

Figure 2:
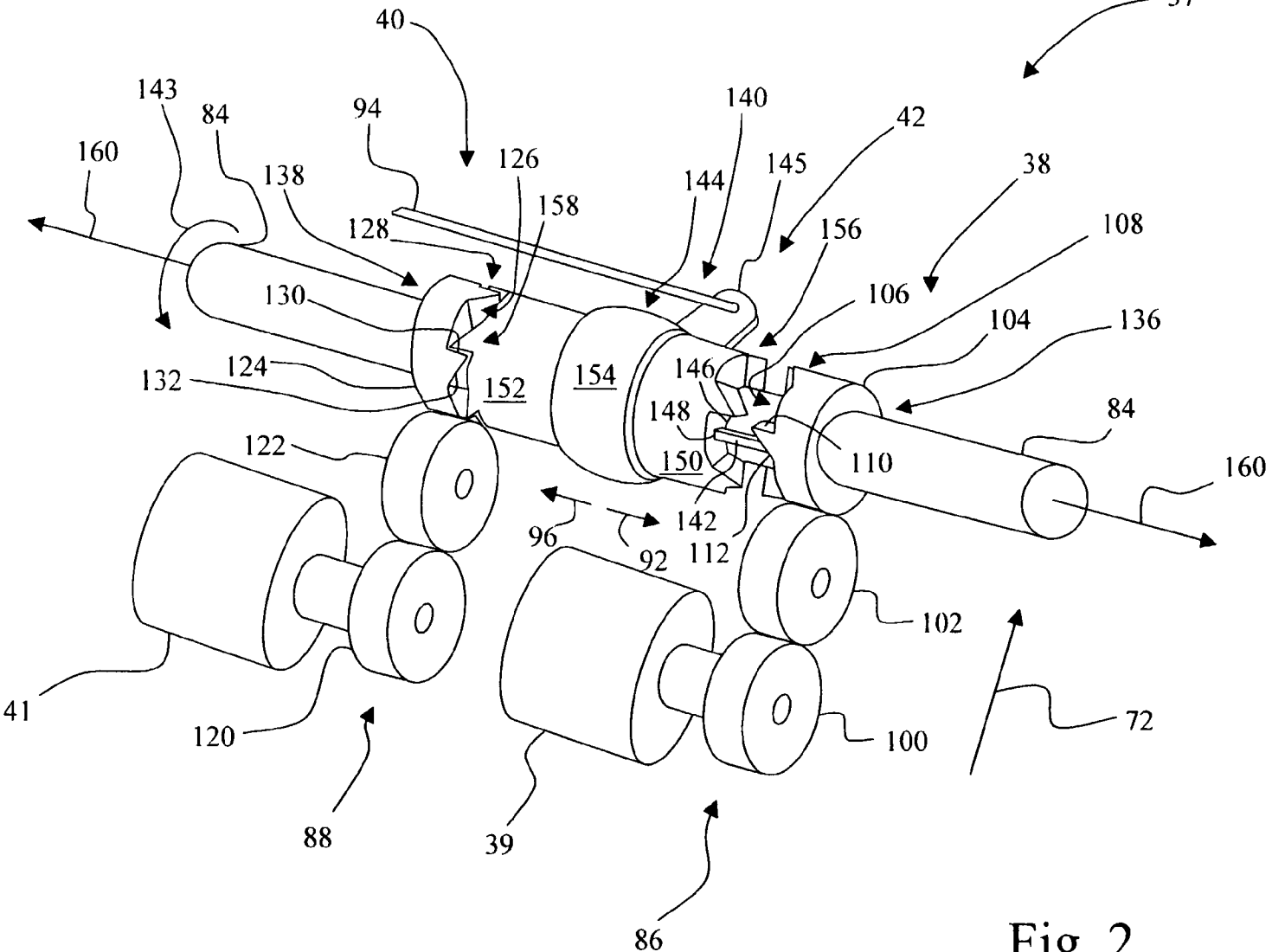
FIG. 2 is a diagrammatic rear view illustration in perspective view of one embodiment of a sheet picking mechanism selector device in accordance with the present invention.
Figure 3:
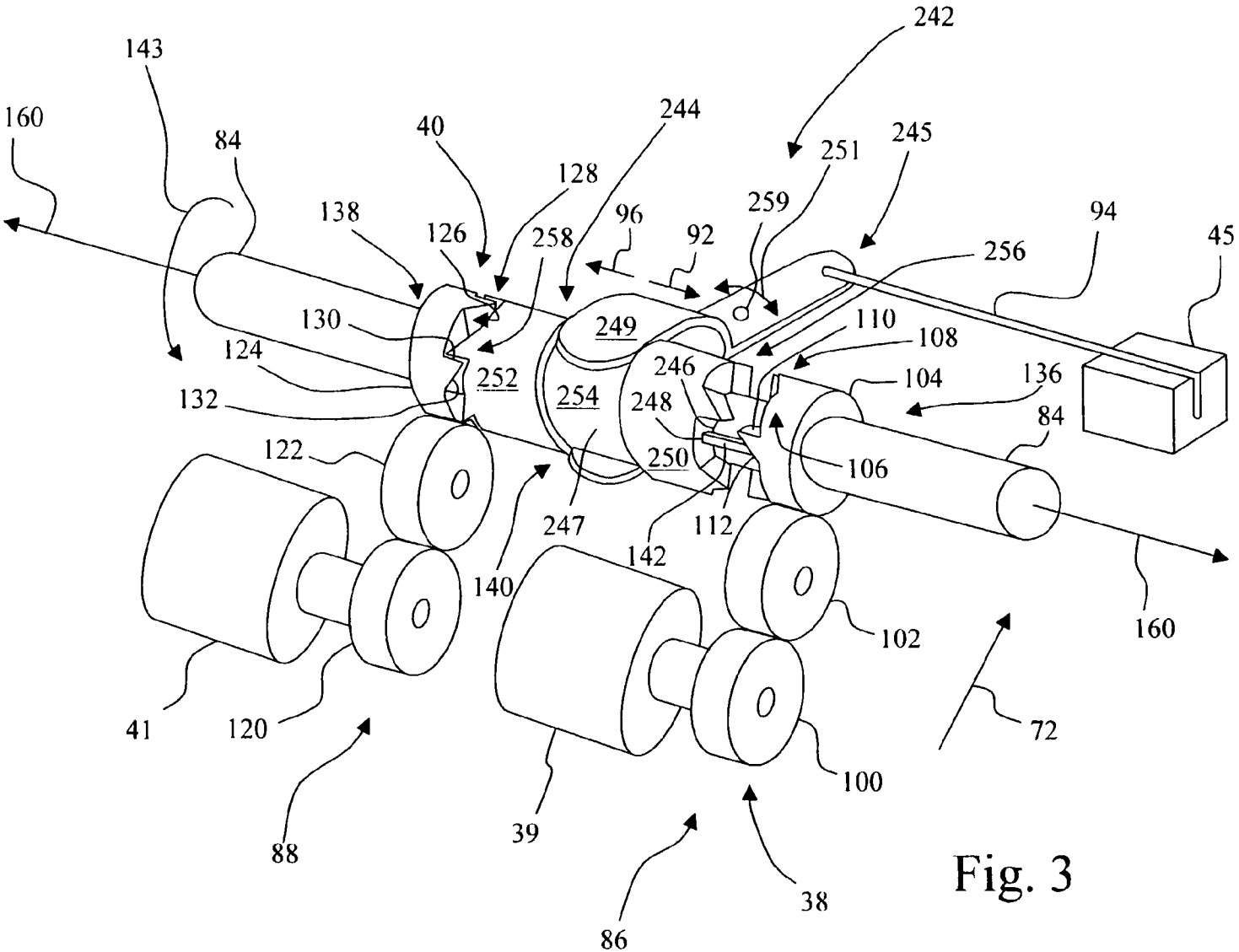
FIG. 3 is a diagrammatic rear view illustration in perspective view of another embodiment of a sheet picking mechanism selector device in accordance with the present invention.

Those skilled in the art will recognize that the selector linkage 94 may be configured as a straight linkage, as shown in FIG. 2, or as a pivoting linkage, as shown in FIG. 3, depending on the particular arrangement of components in imaging apparatus 14.

FIG. 2 shows a rear view, with respect to FIG. 1, of an embodiment of sheet picking assembly 37, including primary sheet picking mechanism 38, secondary sheet picking mechanism 40 and sheet picking mechanism selector device 42.

Primary sheet picking mechanism 38 contains within pivot arm 86 (see FIG. 1) a pick roller gear 100, an intermediate gear 102 and a drive gear 104. Pick roller gear 100 is connected to sheet picking roller 39. A circumferential surface of each of pick roller gear 100, intermediate gear 102 and drive gear 104 may include a plurality of teeth (not shown) for transferring rotary motion from drive gear 104 to intermediate gear 102, and in turn, to pick roller gear 100.

Drive gear 104 has a side surface 106 facing sheet picking mechanism selector device 42. Side surface 106 includes a driven member 108 in the form of a plurality of teeth. Each of teeth of driven member 108 includes a drive surface 110 and a ramped surface 112. Drive surface 110 provides positive engagement with the corresponding teeth of sheet picking mechanism selector device 42, and ramped surface 112 facilitates initial engagement of sheet picking mechanism selector device 42 with driven member 108 of drive gear 104.

Secondary sheet picking mechanism 40 contains within pivot arm 88 (see FIG. 1) a pick roller gear 120, an intermediate gear 122 and a drive gear 124. Pick roller gear 120 is connected to sheet picking roller 41. A circumferential surface of each of pick roller gear 120, intermediate gear 122 and drive gear 124 may include a plurality of teeth (not shown) for transferring rotary motion from drive gear 124 to intermediate gear 122, and in turn, to pick roller gear 120.

Drive gear 124 has a side surface 126 facing sheet picking mechanism selector device 42. Side surface 126 includes a driven member 128 in the form of a plurality of teeth. Each of teeth of driven member 128 includes a drive surface 130 and a ramped surface 132. Drive surface 130 provides positive engagement with the corresponding teeth of sheet picking mechanism selector device 42, and ramped surface 132 facilitates initial engagement of sheet picking mechanism selector device 42 with driven member 128 of drive gear 124.

Within sheet picking assembly 37, sheet pick drive shaft 84 includes a first section 136, a second section 138, and an intermediate section 140 located between first section 136 and second section 138. Intermediate section 140 includes at least one spline 142. Drive gear 104 is rotatably coupled to first section 136 of sheet pick drive shaft 84, and may be retrained along directions 92, 96, for example, by snap rings (not shown). Drive gear 124 is rotatably coupled to second section 138 of sheet pick drive shaft 84, and also may be retrained along directions 92, 96, for example, by snap rings (not shown). Sheet pick drive shaft 84 is rotatable, for example, in the direction indicated by arrow 143.

In the embodiment of the present invention shown in FIGS. 1 and 2, sheet picking mechanism selector device 42 includes an engagement sleeve 144 and an extension member 145. Engagement sleeve 144 includes a bore 146 having a spline channel 148. Spline channel 148 is configured to slidably receive spline 142 of intermediate section 140 of sheet pick drive shaft 84.

Engagement sleeve 144 has a first end portion 150, a second end portion 152 and an intermediate portion 154 located between first end portion 150 and said second end portion 152. First end portion 150 has a drive member 156 in the form of a plurality of teeth configured to be complimentary to the teeth of driven member 108. Drive member 156 is positioned to selectably engage driven member 108 of drive gear 104. Second end portion 152 has a drive member 158 in the form of a plurality of teeth configured to be complimentary to the teeth of driven member 128. Drive member 158 is positioned to selectably engage driven member 128 of drive gear 124.

Extension member 145 is coupled to intermediate portion 154 of engagement sleeve 144. Extension member 145 provides an offset attachment point for coupling selector linkage 94 to engagement sleeve 144. Selector linkage 94 is configured to slide engagement sleeve 144 along an axis 160 of sheet pick drive shaft 84 to selectively position engagement sleeve 144 in driving engagement with one of first drive gear 104 and second drive gear 124.

Thus, depending on the selection made by sheet picking mechanism selector device 42, via the position of printhead carrier 45, sheet pick drive shaft 84 may be selectively coupled via engagement sleeve 144 to one of drive gear 104 located in pivoting arm 86 so as to apply a rotational force to sheet picking roller 39, or selectively coupled to drive gear 124 located in pivoting arm 88 so as to apply a rotational force to sheet picking roller 41.

For example, with the orientation of components as shown in FIGS. 1 and 2, by shifting printhead carrier 45 in direction 96 to the far-right in FIG. 1, printhead carrier 45 will engage a portion of selector linkage 94. In turn, when using the straight linkage configuration of FIG. 2 (i.e., extension member 145 does not pivot), sheet picking mechanism selector device 42, including engagement sleeve 144, will shift in direction 96 to thereby selectively couple sheet pick drive shaft 84 to drive gear 124 located in pivoting arm 88, so as to apply a rotational force to sheet picking roller 41, and in turn, to pick secondary print media 36 from secondary media tray 34.

Upon shifting printhead carrier 45 in direction 92, spring assembly 90 will bias sheet picking mechanism selector device 42 in direction 92 to thereby selectively couple sheet pick drive shaft 84 to drive gear 104 located in pivoting arm 86, so as to apply a rotational force to sheet picking roller 39, to pick primary print media 32 from primary media tray 30. In other words, sheet picking mechanism selector device 42 will be returned to its default position to pick from primary media tray 30 as printhead carrier 45 moves away from the far-right position in FIG. 1.

FIG. 3 shows a rear view of another embodiment of the present invention, which replaces sheet picking mechanism selector device 42, including the straight linkage formed by extension member 145 and engagement sleeve 144, with a sheet picking mechanism selector device 242, including an engagement sleeve 244 and a pivoting linkage 245.

The arrangement of FIG. 3 effectively provides a reversal of the selective driving of one of sheet picking roller 39 and sheet picking roller 41 from that described above with respect to FIG. 2. As such, the location of selector linkage 94 is reversed with respect to the configuration shown in FIG. 1, such that printhead carrier 45 would engage selector linkage 94 with a far-leftward movement, with respect to FIG. 1, of printhead carrier 45 in direction 92.

In the embodiment of the present invention shown in FIG. 3, engagement sleeve 244 includes a bore 246, an annular recess 247, and at least one spline channel 248 located along bore 246. Each spline channel 248 is configured to slidably receive a corresponding spline 142 of intermediate section 140 of sheet pick drive shaft 84. Pivoting linkage 245 includes a yoke 249 that engages annular recess 247 in engagement sleeve 244. Yoke 249 is configured to slide engagement sleeve 244 along an axis 160 of sheet pick drive shaft 84 to selectively position engagement sleeve 244 in driving engagement with one of first drive gear 104 and second drive gear 124 as pivot linkage 245 pivots in one of pivot directions 251.

Engagement sleeve 244 has a first end portion 250, a second end portion 252 and an intermediate portion 254 located between first end portion 250 and said second end portion 252. First end portion 250 has a drive member 256 in the form of a plurality of teeth configured to be complementary to the teeth of driven member 108. Drive member 256 is positioned to selectably engage driven member 108 of drive gear 104. Second end portion 252 has a drive member 258 in the form of a plurality of teeth configured to be complementary to the teeth of driven member 128. Drive member 258 is positioned to selectably engage driven member 128 of drive gear 124.

Depending on the position of printhead carrier 45, sheet pick drive shaft 84 may be selectively coupled via engagement sleeve 244 to one of a drive gear 104 located in pivoting arm 86 so as to apply a rotational force to sheet picking roller 39, or selectively coupled to a drive gear 124 located in pivoting arm 88 so as to apply a rotational force to sheet picking roller 41.

Selector linkage 94 is connected to pivot linkage 245. Pivot linkage 245 pivots about a pivot member 259, such as for example, when acted upon by selector linkage 94.

With the orientation of components as shown in FIG. 3, by shifting printhead carrier 45 in direction 92, printhead carrier 45 will engage a portion of selector linkage 94. In turn, when using the pivot linkage 245 configuration of FIG. 3, engagement sleeve 244 of sheet picking mechanism selector device 242 will shift in direction 96 to thereby selectively couple sheet pick drive shaft 84 to drive gear 124 located in pivoting arm 88, so as to apply a rotational force to sheet picking roller 41, and in turn, to pick secondary print media 36 from secondary media tray 34.

Upon shifting printhead carrier 45 in direction 96, spring assembly 90 (as in FIG. 1) will bias engagement sleeve 244 of sheet picking mechanism selector device 242 in direction 92 to thereby selectively couple sheet pick drive shaft 84 to drive gear 104 located in pivoting arm 86, so as to apply a rotational force to sheet picking roller 39, to pick primary print media 32 from primary media tray 30. In other words, sheet picking mechanism selector device 242 will be returned to its default position to pick from primary media tray 30.

While this invention has been described with respect to an embodiment of the present invention, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An imaging apparatus, comprising:

a printhead carrier system including a printhead carrier configured for movement along a scan path;

a first sheet picking mechanism;

a second sheet picking mechanism; and a selector device configured to select one of said first sheet picking mechanism and said second sheet picking mechanism for picking a sheet of print media based on a position of said printhead carrier.

2. The imaging apparatus of claim 1, comprising:

a sheet pick drive shaft for transferring a motive force; and a sheet pick drive unit coupled to said sheet pick drive shaft, said selector device including an engagement sleeve received over said sheet pick drive shaft for selectively coupling said motive force from said sheet pick drive shaft to one of said first sheet picking mechanism and said second sheet picking mechanism.

3. The imaging apparatus of claim 2, comprising a linkage, said linkage being coupled to said engagement sleeve, said printhead carrier engaging said linkage to effect a translation of said engagement sleeve along an axis of said sheet pick drive shaft.

4. The imaging apparatus of claim 2, comprising an assembly for biasing said engagement sleeve into engagement with one of said first sheet picking mechanism and said second sheet picking mechanism to define one of said first sheet picking mechanism and said second sheet picking mechanism as a default sheet picking mechanism.

5. The imaging apparatus of claim 1, said first sheet picking mechanism including:

a first pick roller;

a first pick roller gear coupled to said first pick roller;

a first drive gear for transferring a motive force; and at least one intermediate gear for transferring said motive force of said first drive gear to said first pick roller gear.

6. The imaging apparatus of claim 1, said second sheet picking mechanism including:

a second pick roller;

a second pick roller gear coupled to said second pick roller;

a second drive gear for transferring a motive force; and at least one intermediate gear for transferring said motive force of said second drive gear to said second pick roller gear.

7. The imaging apparatus of claim 1, comprising:

a drive shaft having a first section, a second section, and a third section located between said first section and said second section, said third section including a spline;

said first sheet picking mechanism including a first drive gear rotatably coupled to said first section of said drive shaft, said first drive gear including a first driven member;

said second sheet picking mechanism including a second drive gear rotatably coupled to said second section of said drive shaft, said second drive gear including a second driven member;

an engagement sleeve including a bore having a spline channel, said spline channel being configured to slidably receive said spline of said third section of said drive shaft, said engagement sleeve having a first end, a second end and an intermediate portion located between said first end and said second end, said first end having a first drive member for selectably engaging said first driven member of said first drive gear, said second end having a second drive member for selectably engaging said second driven member of said second drive gear; and a selector linkage coupled to said engagement sleeve, said selector linkage being configured to slide said engagement sleeve along an axis of said drive shaft to selectively position said engagement sleeve in engagement with one of said first driven member of said first drive gear and said second driven member of said second drive gear.

8. The imaging apparatus of claim 7, wherein each of said first driven member and said second driven member include a side surface having a plurality of teeth.

9. The imaging apparatus of claim 8, wherein each of said first drive member and said second drive member of said engagement sleeve include a plurality of teeth configured to be complementary to said plurality of teeth of said first driven member and said second driven member, respectively.

10. The imaging apparatus of claim 7, said selector linkage being a pivot linkage.

11. A sheet picking device for an imaging apparatus, comprising:

a first sheet picking mechanism;

a second sheet picking mechanism;

a drive shaft having a first section, a second section, and a third section located between said first section and said second section, said third section including a spline;

said first sheet picking mechanism including a first drive gear rotatably coupled to said first section of said drive shaft, said first drive gear including a first driven member;

said second sheet picking mechanism including a second drive gear rotatably coupled to said second section of said drive shaft, said second drive gear including a second driven member;

an engagement sleeve including a bore for receiving said drive shaft, said bore having a spline channel, said spline channel being configured to slidably receive said spline of said third section of said drive shaft, said engagement sleeve having a first end, a second end and an intermediate portion located between said first end and said second end, said first end having a first drive member for selectably engaging said first driven member of said first drive gear, said second end having a second drive member for selectably engaging said second driven member of said second drive gear; and a selector linkage coupled to said engagement sleeve, said selector linkage being configured to slide said engagement sleeve along an axis of said drive shaft to selectively position said engagement sleeve in engagement with one of said first driven member of said first drive gear and said second driven member of said second drive gear.

12. The sheet picking device of claim 11, wherein each of said first driven member and said second driven member include a side surface having a plurality of teeth.

13. The sheet picking device of claim 12, wherein each of said first drive member and said second drive member of said engagement sleeve include a plurality of teeth configured to be complementary to said plurality of teeth of said first driven member and said second driven member, respectively.

14. The sheet picking device of claim 11, said selector linkage being a pivot linkage.

15. The sheet picking device of claim 11, comprising an assembly for biasing said engagement sleeve into engagement with one of said first drive member of said first sheet picking mechanism and said second drive member of said second sheet picking mechanism so as to define one of said first sheet picking mechanism and said second sheet picking mechanism as a default sheet picking mechanism.

16. The sheet picking device of claim 11, said first sheet picking mechanism further including:

a first pick roller;

a first pick roller gear coupled to said first pick roller; and at least one intermediate gear for transferring a motive force from said first drive gear to said first pick roller gear.

17. The sheet picking device of claim 11, said second sheet picking mechanism further including:

a second pick roller;

a second pick roller gear coupled to said second pick roller; and at least one intermediate gear for transferring a motive force from said second drive gear to said second pick roller gear.

* * * * *